US008668518B2

(12) United States Patent
Wu

(10) Patent No.: US 8,668,518 B2
(45) Date of Patent: Mar. 11, 2014

(54) DATA BUS STRUCTURE FOR TERMINAL BLOCKS AND TERMINAL BLOCKS USING THE SAME

(75) Inventor: Shang-Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 72 days.

(21) Appl. No.: 13/417,386

(22) Filed: Mar. 12, 2012

(65) Prior Publication Data

US 2013/0237067 A1 Sep. 12, 2013

(51) Int. Cl.
*H01R 13/66* (2006.01)

(52) U.S. Cl.
USPC ..... 439/532; 439/709

(58) Field of Classification Search
USPC ..... 439/110–120, 527, 532, 533, 709, 719
See application file for complete search history.

(56) References Cited

U.S. PATENT DOCUMENTS

| | | | | |
|---|---|---|---|---|
| 2,283,398 | A * | 5/1942 | Van Deventer | 439/120 |
| 4,472,764 | A * | 9/1984 | Richard et al. | 361/775 |
| 5,716,241 | A * | 2/1998 | Hennemann et al. | 439/716 |
| 5,745,338 | A * | 4/1998 | Bartolo et al. | 361/637 |
| 6,086,388 | A * | 7/2000 | Sloey et al. | 439/110 |
| 6,517,363 | B2 * | 2/2003 | Ross | 439/115 |
| 6,568,860 | B2 * | 5/2003 | Koch et al. | 385/53 |
| 7,188,805 | B2 * | 3/2007 | Henley et al. | 244/118.5 |
| 7,370,831 | B2 * | 5/2008 | Laib et al. | 244/118.5 |
| 7,503,522 | B2 * | 3/2009 | Henley et al. | 244/118.5 |
| 8,147,257 | B2 * | 4/2012 | Bury et al. | 439/110 |
| 8,167,632 | B2 * | 5/2012 | Bruetsch et al. | 439/114 |

* cited by examiner

*Primary Examiner* — Thanh Tam Le
(74) *Attorney, Agent, or Firm* — Bacon & Thomas, PLLC

(57) ABSTRACT

A data bus structure for the terminal blocks, comprising: a main body to be plugged into a support rail for the terminal blocks; said main body comprising a plurality of slots formed therein; and at least 2 conductive pieces to be inserted in said slots of said main body to form guiding rail. The data bus structure provides a data bus for a plurality of terminal blocks for the transmission of electricity and signals, as well stable supports to the terminal blocks.

8 Claims, 3 Drawing Sheets

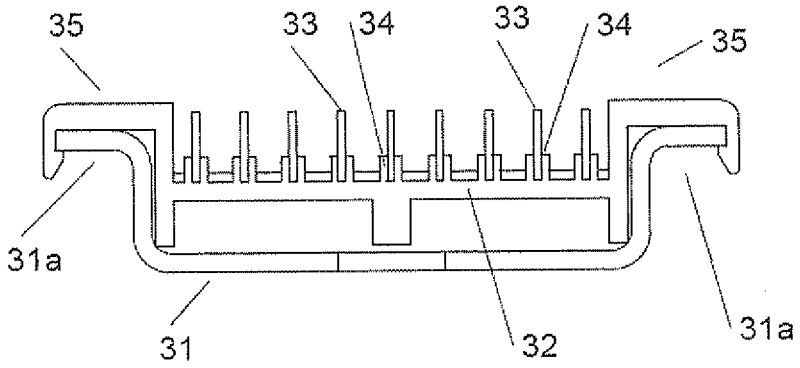
Fig. 3
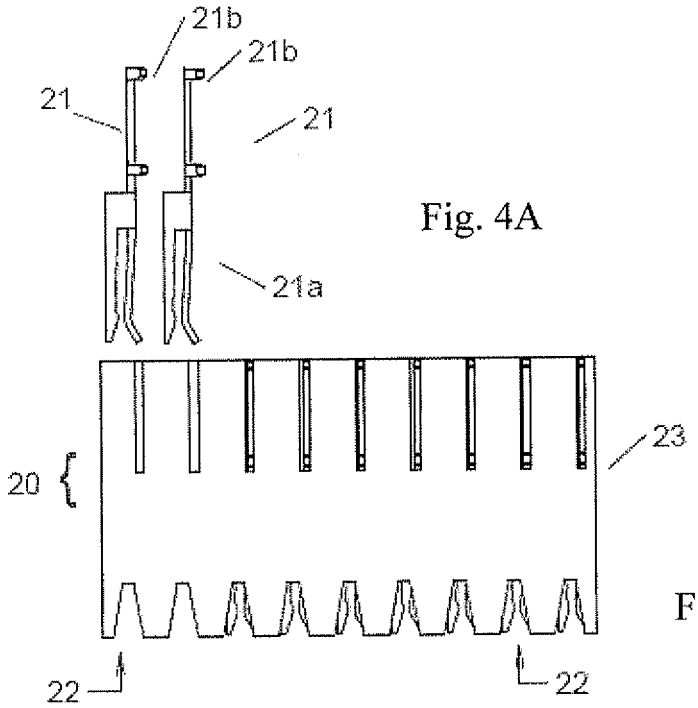
Fig. 4A
Fig. 4

DATA BUS STRUCTURE FOR TERMINAL BLOCKS AND TERMINAL BLOCKS USING THE SAME

FIELD OF THE INVENTION

The present invention relates to the structure of data bus for terminal blocks and terminal blocks using the data bus structure, especially to data bus structure that couples a plurality of terminal blocks and terminal blocks using the data bus structure.

BACKGROUND OF THE INVENTION

The terminal block is a component widely used in all kinds of working machines. The terminal block is used to couple two or more sets of power lines, control lines or data lines. In general, in a working machine dozens to hundreds of terminal blocks are used, to supply electric power, control or data signals. In the operation and control of a working machine, two or more terminal blocks are coupled in an array, in order to share the electric power or the data or control signals.

In the conventional art, there two ways in coupling a plurality of terminal blocks. The first method is to provide a connector in each terminal block. The connector provides a plurality of T-shaped connector pins and an insulation body that encapsulates the connector pins. The insulation body provides 3 connecting units, in which 2 connecting units in the horizontal direction respectively are constructed complementarily to one another, so to produce electrical connections to other connectors having respective complementary connecting units, and a third connecting unit orients substantially perpendicular to the first and second connecting units, to produce electrical connections to the internal circuits of the terminal block. An exemplary structure of such a T-shaped connector is described in U.S. Pat. No. 7,704,079, "T-shaped shielded bus connector." Detailed description of the structure and the fabrication of the T-shaped connector may be found in U.S. Pat. No. 6,033,264, "Electrical or electronic device for seating on a mounting rail and process for producing same."

The other type of the coupling is called "data bus." An exemplary design in the data bus structure is disclosed in U.S. Pat. No. 5,716,241, "I/O device for a data bus." According to the disclosure of this U.S. patent, a support rail is provided to detachably and slidably support a plurality of terminal blocks thereon. A data bus structure is provided in the support rail. In the terminal blocks a connector is provided to couple the conductive lines in the data bus. The data bus structure includes a circuit board and a plurality of conductive lines formed thereon, with each pair of conductive lines being arranged in parallel and in substantially identical distance. The connector includes a plurality of connector pins and an insulation body encapsulating the connector pins. The insulation body provides 2 connecting units, wherein one connecting unit couples with the internal circuits of the terminal block and the other couples its connector pins to the conductive lines of the data bus structure. In order to ensure the connections between the connector pins of the connector and the conductive lines of the data bus structure, contact springs or elastic pieces are provided at the connecting end of the connector pins. The contact springs extrude from the connecting unit and press the conductive lines of the data bus structure.

The above-described approaches provide effective solutions for the lateral connection of terminal blocks. However, the T-shaped connector has a complicated structure. The connector pins are fabricated in a plurality of steps. In many cases the connector pin must include a plurality of parts. In addition, the insulation body is also an assembly of a plurality of parts. High material costs and long assembly time are expected.

Compared to the T-shaped connector, the data bus structure is a favorable design, mainly because the support rail is an industrially standard component, used in the support of a plurality of terminal blocks. In this approach, the data bus structure is enclosed and supported in the support rail that is already a part of the terminal block system. The use of the data bus structure further simplifies the structure of the connector pins of the connector, if compared with the T-shaped connector. However, in the data bus structure the connections between the connector pins and the conductive lines are not stable. The use of the contact spring in assuring the connections does not only increase the cost of the connector but also make the structure of the connector pins complicated.

It is thus necessary to provide a novel data bus structure for the terminal blocks that provides stable electrical connections between the connector pins of the terminal block and the conductive lines of the data bus structure.

It is also necessary to provide a data bus structure for the terminal blocks that has simplified structure, is easy to assemble and is fabricated in low costs.

It is also necessary to provide a data bus structure for the terminal blocks to simplify the structure of the corresponding connector and its connector pins.

OBJECTIVES OF THE INVENTION

The objective of this invention is to provide a novel data bus structure for the terminal blocks that provides stable electrical connections between the connector pins of the terminal block and the conductive lines of the data bus structure.

Another objective of this invention is to provide a data bus structure for the terminal blocks that has simplified structure, is easy to assemble and is fabricated in low costs.

Another objective of this invention is to provide a data bus structure for the terminal blocks, with its corresponding connector and connector pins thereof being simplified.

SUMMARY OF THE INVENTION

According to this invention, a novel data bus structure for the terminal blocks is provided. The data bus structure for the terminal blocks of this invention comprises:

a main body to be plugged into a support rail for the terminal blocks; said main body comprising a plurality of slots formed therein; and at least 2 conductive pieces to be inserted in said slots of said main body to form guiding rails.

The data bus structure for the terminal blocks may further comprise connecting pieces provided in said main body, to fix or slidably fix said main body in said support rail. The connecting piece may be a fastener and may be formed integrally with said main body. The data bus structure for the terminal blocks may further comprise at least one non-conductive piece, to be inserted in said slots to form a part of said guiding rail.

The invented data bus structure for the terminal blocks may further comprise a connector, comprising:

a plurality of connector pins, each having a first terminal in electrical connection with said conductive piece or in connection with said non-conductive piece; and an insulation body encapsulating said plurality of connector pins and providing a plurality of recessions to allow said conductive pieces and/or said non-conductive pieces to be inserted therein.

In some embodies of this invention, the connector pins and side walls of the recessions in the connector together clip the conductive pieces or the non-conductive pieces, when they are inserted in the recessions. In other embodiments, the connector pins of the connector clip the conductive pieces or the non-conductive pieces, when they are inserted in the recessions.

In some embodiments, the second terminal of said connector pins orients substantially perpendicular to the first terminal.

The present invention also includes terminal blocks including the data bus structure for the terminal blocks as described above. The terminal block comprises:

a circuit board to connect at least 2 wires, with necessary circuits formed therein;

a connector, comprising a plurality of terminal pins each having at least one first terminal to electrically connect a conductive piece and one second terminal to electrically connect circuits of said circuit board; and insulation body encapsulating said plurality of connector pins and providing a plurality of recessions to allow said conductor piece to be inserted therein.

The terminal block of this invention may further include housing to encapsulate said circuit board. The housing may further encapsulate at least a part of said connector. The connector may include connecting pieces, to fix the connector to the circuit board.

According to the present invention, the data bus structure for the terminal blocks uses conductive pieces as the conductive lines of the data bus. The conductive pieces does not only provide the transmission of electricity and data signals but also firmly support the plurality of terminal blocks in the support rail. As a result, the plurality of terminal blocks may be arranged in an array in the support rail and share the data bus structure. In addition, the data bus structure for the terminal blocks may be easily mounted in the support rail, which is already a part of the terminal block system. In other words, the data bus structure for the terminal blocks does not require additional space or additional support, while providing stable electrical connections between the connector pins and the conductive pieces/lines.

Nevertheless, the selective use of the conductive pieces and the non-conductive pieces gives versatility to the design of the data bus structure. The data bus structure is thus freed from the limitations in the conventional art.

These and other objectives and advantages of this invention will be clearly appreciated from the following detailed description by referring to the following drawings.

BRIEF DESCRIPTION OF THE DRAWINGS

FIG. 3 is its cross-sectional view.

FIG. 4 is the perspective view of the connector used in the present invention, while FIG. 4A is the perspective view of its connector pins.

DETAILED DESCRIPTION OF THE INVENTION

Figure 1:
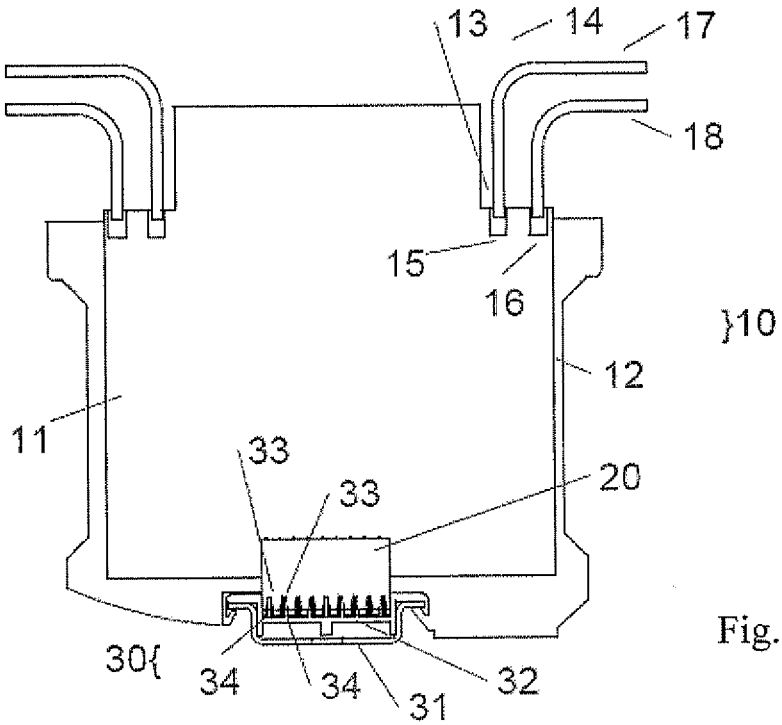
FIG. 1 illustrates the schematics of the data bus structure and the terminal blocks of this invention.

Detailed description of the data bus structure for the terminal blocks of this invention will be given by illustrating certain embodiments. FIG. 1 illustrates the schematics of the data bus structure and the terminal blocks of this invention. In this figure, reference number 10 represents a terminal block, including a circuit board 11 and a housing 12. Connecting though holes 13, 14 are provided in the housing 12. Connecting parts 15, 16 are provided in the circuit board 11. The connecting through holes 13, 14 and the connecting parts 15, 16 are provided to connect and support electrical wires 17, 18. Necessary circuits and lines are formed in the circuit board 11.

The connecting through holes 13, 14 may be formed in integrity with the housing 12 and a depth is provided therein, to allow the electrical wires 17, 18 to fix firmly to the circuit board 11. The connector parts 15, 16 provide a conductive piece, to be in electrical connection with the electrical wires 17, 18. The electrical wires 17, 18 may be soldered to the connector parts 15, 16. In addition, a clamp (not shown) may be provided at the connector parts 15, 16, to detachably fix the electrical wires 17, 18 to the connector parts 15, 16. The structure of the terminal block is well known to those skilled in the art. Detailed descriptions to the material, shape, structure and additions are thus omitted.

Connector 20 is provided at the lower part of the terminal block 10, as shown in FIG. 1. In the connector 20, a plurality of connector pins 21, 21 are provided and are encapsulated by the insulation body 23, see also FIG. 4. One terminal of the connector pins 21, 21 is connected to the circuits in the circuit board 11. The connector 20 connects the circuit board 11 at its one side. Optionally, connecting pieces, such as connecting extruders, may be provided, to engage with the complementary parts, such as recessions or holes (not shown) provided in the circuit board 11, to further strengthen the connection of the two elements.

The data bus structure 30 is shown at the lowest part of FIG. 1 and includes a support rail 31, data bus structure main body 32 and a plurality of conductive pieces 33, 33 positioned in the main body 32. The support rail 31 is one of the standard elements in the application of the terminal blocks and used to support a plurality of terminal blocks. The main body 32 is configured to have the shape and size to be housed in the space defined by the support rail 31. As a result of this arrangement, the invented data bus structure utilizes the space already defined and included in the existing device; therefore no additional space is required. The conductive piece 33 is a longitudinal strip of certain width and extrudes upward to some extend from the main body 32, when inserted in one of the slots of the main body 32, to form a guiding rail. According to the embodiments of this invention, recessions 22, 22 with the shape in complementary with the extruded parts of the conductive pieces are provided in the insulation body 23, in the same number of the conductive pieces. When the conductive pieces 33, 33 are inserted in the main body 32, with their high parts extruding from the main body 32, the connector 20 may be mounted to the guide rail formed by the conductive pieces 33, 33, with the extruded portions inserted into the recessions 22, 22. The connector pins 21, 21 of the connector 20 clip the conductive pieces 33, 33, when they are inserted in the recessions 22, 22. As a result, the connector 20 and the corresponding terminal block 10 are slidably supported in the support rail 31.

Alternatively, the connector pins 21, 21 and side walls of the recessions 22, 22 in the connector 20 together clip the conductive pieces 33, 33, when they are inserted in the recessions 22, 22.

Figure 2:
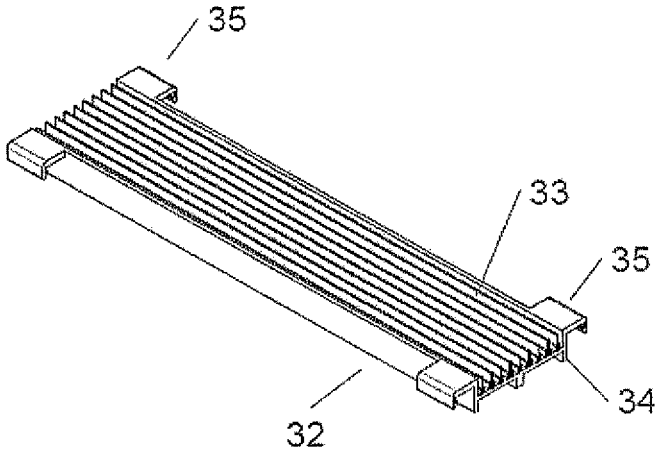
FIG. 2 is the perspective view of the first embodiment of the invented data bus structure for the terminal blocks.

More details of the data bus structure 30 and the connector 20 will be given in the followings. FIG. 2 is the perspective view of the first embodiment of the invented data bus structure for the terminal blocks and FIG. 3 is its cross-sectional view. As shown in these figures, the data bus structure 30 includes the data bus structure main body 32 and a plurality of conductive pieces 33, 33. The conductive pieces 33, 33 are made of conductive metal and are in the form of flat metal strips, configured to be inserted in the plurality of slots 34, 34 of the main body 32. The conductive pieces 33, 33 are not limited to any particular number in quantity. However, if the data bus structure 30 provides electricity in addition to data signals, the number of the conductive pieces shall be more than 2. The conductive pieces 33, 33 are not limited to any material, as long as they are electrically conductive and provide substantial supports to the terminal blocks 10 supported thereon. In general, the material of the conductive pieces 33, 33 is preferably metal or alloy with certain rigidity. It is also possible to fabricate the conductive pieces 33, 33 with other materials, with metal or metal alloys coated thereon. Other non-metal conductive materials are also applicable. In other embodiments, not all the slots 34, 34 are inserted by the conductive pieces 33, 33. Selected slots may be left vacant. In further other embodiments, a part or all the slots 34, 34 are inserted with non-conductive pieces. In such arrangements, the non-conductive pieces provide supports to the terminal blocks. When both the conductive pieces and the non-conductive pieces are inserted in the slots, the non-conductive pieces provide supports and identification functions to the terminal blocks. The conductive pieces 33, 33, including the non-conductive pieces may be applied with same or different colors, in part or in full, to provide identification functions. If necessary, 2 or more conductive pieces may be shorted to serve for particular functions.

In the figures, the shape of the main body 32 is shown in a configuration that may be mounted into the internal space defined by the support rail 31. As described above, the support rail 31 is one of the standard components of the terminal block system. It has the U shape, with a flat bottom. The internal space forms a reverse mesa space. According to the embodiments of this invention, the shape and size of the main body 32 are preferably configured to fit into the internal space of the support rail 31. Approximately 8-10 conductive pieces may be arranged in the main body 32. In addition to 2 conductive pieces that supply electricity, 6-8 conductive pieces remain to function as signal lines; therefore are sufficient for most applications. The material of the support rail 31 may be a low-cost metal, such as aluminum or alloys containing aluminum, while other materials such as plastic, rubber, resin, wood, paper or other composite materials are also usable. Of course, the support rail 31 is not limited to any particular shape and size. In this embodiment, a standard support rail is used with the purpose of using the standard component without the need of providing additional elements. In other words, using the standard support rail is not any technical limitation; it's only for convenience.

A plurality of slots 34, 34 is formed in the main body 32. In practice, the slots 34, 34 are formed integrally with the main body 32. It is also possible to prepare an element to include the slots and assembly the element with the main body. The material of the main body 32 is preferably non-conductive, such as plastic, rubber, resin, wood, paper or a composite material. It is also possible to prepare the main body 32 with a conductive material, with non-conductive material coated thereon. The slots are not limited to any particular number, if sufficient supports to the terminal blocks 10 are provided. However, since the plurality of connector pins 21, 21 is arranged parallel in most applications, they provide sufficient supports to the terminal blocks as well. In addition, certain space between each pair of conductive pieces is recommended, so that undesired short of the conductive pieces won't take place. The number of the slots that may be provided in the main body 32 is somehow limited by this condition. As to the thickness and height (wideness) of the conductive pieces, they may be determined by the designers of the data bus structure according to their experiences and considerations.

Figure 5:
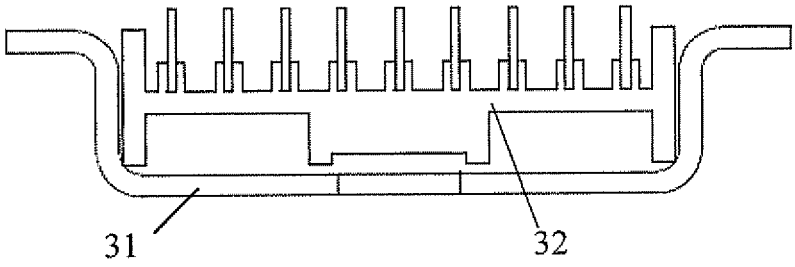
FIG. 5 is the perspective view of the second embodiment of the invented data bus structure for the terminal blocks.

Connecting pieces 35, 35 may be provided in the data bus structure main body 32. In this embodiment, the connecting pieces 35, 35 have the wing-shape and override on the respective wings 31*a*, 31*a* of the support rail 31, so that the wings 31*a*, 31*a* of the support rail 31 are engaged in the recessions provided below the connecting pieces 35, 35. The elasticity of the main body 32 would thus fasten the main body 32 firmly to the support rail 31. In another embodiment of this invention, no connecting pieces are provided in the main body 32. Instead, the main body 32 is configured to have the shape corresponding to the reversed mesa shape of the internal space of the support rail 31, whereby the 2 side walls of the main body 32 hold out against the internal side walls of the support rail 32, so to affix the main body 32 in the support rail 31. The main body 32 and the support rail 31 after assembly are shown in FIG. 5, which is the cross-sectional view of the second embodiment of this invention. In FIG. 5 elements that are the same as those in FIG. 2 or FIG. 3 are labeled with same numbers. Of course, in the embodiment of FIG. 5, the main body 32 is not limited to having the side walls holding out against the internal side walls of the support rail 31. It is possible to leave a clearance between the side walls of the two elements, whereby main body 32 is slidably affixed in the support rail 31.

The plurality of conductive pieces 33, 33 is inserted in respective slots 34, 34 of the main body 32 to form the data bus structure 30 of this invention. The support rail 31 may be seen as one component of the data bus structure 30.

FIG. 4 is the perspective view of the connector 20 used in the present invention, while FIG. 4A is the perspective view of its connector pins 21, 21. As shown in this figure, the connector 20 includes the insulation body 23 and the plurality of connector pins 21, 21 provided therein. Each of the connector pins 21, 21 has a bus end 21*a*, to form electric contact with the conductive pieces 33, 33 of the data bus structure 30, and a terminal block end 21*b* to connect the circuits and lines (not shown) in the terminal block 10. The connector pin 21 may be inserted into the recessions 22 provided in the insulation body 23 and are fixed therein using the elasticity of the pin 21. In some embodiments of this invention, the connector pins 21, 21 are provided in the insulation body 23 at the formation of the latter, whereby they are firmly supported in the insulation body 23. These and other method of assembling the connector pins 21, 21 to the insulation body 23 have their respective pros and cons and may be selected by those in this industry.

The material of the connector pins 21, 21 may be conductive metal, such as copper, while other metal materials or their alloys and non-metal conductive materials are also applicable. The insulation body 23 is generally made of non-conductive materials, such as plastic, rubber, resin, wood paper or a composite material. Supporting or fixing elements may also be provided in the insulation body 23, so to provide firm connections with the terminal block 10 or its circuit board 11. For example, a plurality of extruders (not shown) may be provided to be engaged with recessions (not shown) provided in the circuit board 11. Other methods include the use of rivets, bolts, soldering and adhesives, to fix the connector 20 to the terminal block 10.

A plurality of recessions 22, 22 is provided in the insulation body 23, to allow the conductive pieces 33, 33 (including the non-conductive pieces) to be inserted therein. In some embodiments of this invention, the bus end 21*a* of the connector pins 21, 21 clips the conductive pieces 33, 33 and the non-conductive pieces. In other embodiments, however, the bus end 21*a* of the connector pins 21, 21 and the side wall of the recessions together clip the conductive pieces 33, 33 and the non-conductive pieces. In the assembly of the present invention, the terminal block 10 is first connected to the connector 20 to produce a terminal block 10 having a connector 20. The connector 20 is then mounted to the data bus structure 30 by inserting the conductive pieces 33, 33 (and/or the non-conductive pieces) to the slots 22, 22 of the connector 20, such that the connector pins 21, 21 or the connector pins 21, 21 and the side walls of the slots 22, 22 together firmly clip the conductive pieces 33, 33 (and/or the non-conductive pieces.) A terminal block with the data bus structure is thus assembled.

FIG. 4A further shows the terminal block end 21*b* of the connector pins 21 orients substantially perpendicular to the bus end 21*a*. In other embodiments, however, the two ends may form an angle of about 180 degrees. The angular degree formed by the two ends may be determined according to the needs in the application. It is not any technical limitation. The shape, configuration and method of fabrication of the connector pins are well known to the industry. Detailed description thereof is thus omitted.

In the design as described above, one data bus structure 30 may be easily mounted in the support rail 31 for the terminal blocks. A plurality of terminal blocks may be mounted to one data bus structure. When mounted, the plurality of terminal blocks may share the conductive pieces of the data bus structure as a data bus may be. The data bus may further include electricity wires. The functionality of the terminal blocks is thus improved.

If compared with the conventional art, the invented data bus structure provides stable supports to the plurality of terminal blocks, as well as stable connections between the connectors and the data bus structure. In the present invention, no contact spring is needed. The data bus structure is simplified. The advantages of this invention include reduced costs and time in the assembly and in the material.

In addition, the invented data bus structure for terminal blocks may be mounted in the support rail, which is already a standard component in the terminal block system. The invented data bus structure does not require additional space to mount. The selective use of the connective pieces and the non-conductive pieces provides further versatility in the application of the terminal blocks.

As the present invention has been shown and described with reference to preferred embodiments thereof, those skilled in the art will recognize that the above and other changes may be made therein without departing form the spirit and scope of the invention.

What is claimed is:

1. A data bus structure for terminal blocks supported by a support rail, comprising:

a main body adapted to fit within an internal space of the support rail for the terminal blocks; said main body comprising a plurality of slots formed therein such that when said main body is fitted within said internal space of said support rail, said plurality of slots is located inside said internal space;

at least two conductive pieces inserted in said slots of said main body to form a guiding rail and data bus connections for said terminal blocks; and at least one non-conductive piece inserted in one of said slots in place of one of said at least two conductive pieces to form a part of said guiding rail without providing a data bus connection.

2. The data bus structure of claim 1, further comprising connecting pieces provided in said main body, to fix said main body in said support rail.

3. The data bus structure of claim 2, wherein said main body is slidably inserted into said support rail and fixed therein.

4. The data bus structure of claim 2, wherein said connecting pieces are fasteners formed integrally with said main body.

5. The data bus structure of claim 1, wherein said terminal blocks each includes a connector, comprising:

a plurality of connector pins, each having a first terminal in electrical connection with one of said conductive pieces; and an insulation body encapsulating said plurality of connector pins and providing a plurality of recessions to allow said conductive pieces to be inserted therein and electrically connected to said connector pins.

6. The data bus structure of claim 5, wherein said connector pins and side walls of said recessions in said connector together clip the conductive pieces, when they are inserted in the recessions.

7. The data bus structure of claim 5, wherein said connector pins of said connector clip the conductive pieces, when they are inserted in the recessions.

8. The data bus structure of claim 5, wherein a second terminal each of said connector pins orients substantially perpendicular to said first terminal.

* * * * *